US011096430B2

(12) United States Patent
Otashevich et al.

(10) Patent No.: US 11,096,430 B2
(45) Date of Patent: Aug. 24, 2021

(54) REINFORCED SEAMED OUTER GARMENTS WITH HIDDEN SUPPORT

(71) Applicant: LANE BRYANT PURCHASING CORP., Columbus, OH (US)

(72) Inventors: Lazar Otashevich, Midland Park, NJ (US); Siobhan Smith, Nutley, NJ (US); Jose Manuel Zavala, Jr., New York, NY (US)

(73) Assignee: LANE BRYANT PURCHASING CORP., Columbus, OH (US)

( * ) Notice: Subject to any disclaimer, the term of this patent is extended or adjusted under 35 U.S.C. 154(b) by 0 days.

(21) Appl. No.: 16/197,693

(22) Filed: Nov. 21, 2018

(65) Prior Publication Data

US 2019/0150540 A1 May 23, 2019

Related U.S. Application Data

(60) Provisional application No. 62/589,937, filed on Nov. 22, 2017.

(51) Int. Cl.

| | |
|---|---|
| ***A41D 1/06*** | (2006.01) |
| ***A41D 27/24*** | (2006.01) |
| ***A41D 1/22*** | (2018.01) |
| *A41D 1/14* | (2006.01) |

(52) U.S. Cl.

CPC ..... *A41D 1/06* (2013.01); *A41D 1/22* (2013.01); *A41D 27/24* (2013.01); *A41D 1/14* (2013.01); *A41D 2300/22* (2013.01); *A41D 2300/50* (2013.01); *A41D 2400/38* (2013.01)

(58) Field of Classification Search

CPC ..... A41D 1/06; A41D 1/22; A41D 27/02; A41D 27/06; A41D 2300/20; A41D 2300/22; A41D 2400/38; A41D 27/24; A41D 31/185; A41D 2300/50

See application file for complete search history.

(56) References Cited

U.S. PATENT DOCUMENTS

| | | | | |
|---|---|---|---|---|
| 3,506,015 | A * | 4/1970 | Gertrude | A41C 1/00 450/152 |
| 6,035,448 | A * | 3/2000 | Thomson | A41D 1/06 2/227 |
| 6,205,591 | B1 * | 3/2001 | Wheeler | A41B 9/08 2/227 |
| 6,367,086 | B1 * | 4/2002 | Woodard | A41D 1/06 2/227 |
| 8,683,616 | B2 | 4/2014 | Zielinski | |
| 8,959,665 | B1 * | 2/2015 | Garner | A41F 9/00 2/236 |
| 9,307,794 | B1 * | 4/2016 | Rumsey | A41D 1/06 |
| 9,894,939 | B1 * | 2/2018 | Sun | A41D 1/06 |
| 2006/0230488 | A1 * | 10/2006 | Rudolph | A41D 1/086 2/69 |
| 2007/0118954 | A1 * | 5/2007 | Lee | A41C 1/003 2/69 |

(Continued)

*Primary Examiner* — Sally Haden

(74) *Attorney, Agent, or Firm* — Hudak, Shunk & Farine Co. LPA

(57) ABSTRACT

A lower body outer garment, such as a pant or legging or skirt, is provided which has a construction and hidden support which helps to redefine the wearer's appearance. The support is provided in the form of internal mesh re-enforcing panels that lift the buttocks and flatten the tummy. The garment also includes external seaming that provides structure and has a visual effect to re-draw the wearer's outline.

10 Claims, 2 Drawing Sheets

(56) References Cited

U.S. PATENT DOCUMENTS

| | | | | |
|---|---|---|---|---|
| 2008/0244805 | A1* | 10/2008 | Griffin | A41C 1/00 2/74 |
| 2010/0192283 | A1* | 8/2010 | Kim | A41D 1/06 2/227 |
| 2010/0192284 | A1* | 8/2010 | Simon | A41D 1/06 2/236 |
| 2011/0099677 | A1* | 5/2011 | Mamiye | A41D 27/02 2/67 |
| 2014/0115747 | A1* | 5/2014 | Spruill | A41D 13/0015 2/22 |
| 2014/0273741 | A1* | 9/2014 | Hays | A41D 1/06 450/95 |
| 2015/0128331 | A1* | 5/2015 | Grosse | A41D 31/185 2/400 |
| 2015/0366270 | A1* | 12/2015 | Delgado | A41F 9/02 450/95 |
| 2016/0029708 | A1* | 2/2016 | Said Battah | A41D 1/06 450/95 |
| 2016/0073718 | A1* | 3/2016 | McKinlay | A41D 31/00 450/95 |
| 2016/0106157 | A1* | 4/2016 | Bickley | A41B 9/12 2/400 |
| 2016/0174642 | A1* | 6/2016 | Rotter | A41D 27/02 450/95 |
| 2016/0255889 | A1* | 9/2016 | Szcepanowski | A41D 1/22 |
| 2017/0042257 | A1* | 2/2017 | Carrer | A41D 1/06 |
| 2018/0263299 | A1* | 9/2018 | Padin | A41C 1/003 |
| 2018/0310639 | A1* | 11/2018 | House | A41B 11/00 |
| 2018/0318142 | A1* | 11/2018 | Gagliardo | A41F 9/00 |
| 2019/0110525 | A1* | 4/2019 | Conte | A41D 1/06 |
| 2019/0320746 | A1* | 10/2019 | Otashevich | A41D 31/02 |
| 2019/0320747 | A1* | 10/2019 | Otashevich | A41D 31/04 |

* cited by examiner

REINFORCED SEAMED OUTER GARMENTS WITH HIDDEN SUPPORT

FIELD OF THE INVENTION

The present invention relates to outer wear for the lower body, and more particularly, to lower garments including pants or leggings, skirts of dresses that redefine the appearance and reshape or sculpt a wearer's lower body, including the lower waist area, the hips, thighs, buttocks and legs.

BACKGROUND OF THE INVENTION

Material advances of the last century have allowed fashion to move toward garments that both shape and move with the wearer. In particular, this has included the drive toward lower outerwear that accentuates the feminine figure. However, this trend has created a gap in the plus-size market, in particular for women who want to appear au current, but who are intimidated to dress in clothing that reveals rather than covers their shape. The present invention is designed to provide an option in garments, including for example, pants or leggings, that allow these people to participate in these fashion trends.

SUMMARY OF THE INVENTION

The present invention relates to an outer garment for the lower body, including for example, hosiery, legging, pant, slacks, trousers and even skirts or dresses, which are structured so as to provide support and definition to the wearer's body, including, the waist, hips, abdominals, buttocks, thighs, and legs. The garment may advantageously extend down the leg to the mid-thigh, knee, mid-calf or ankle, although it should be understood that inventive features may be incorporated into garments having differing configurations.

The outer garment termed "legging" herein, is preferably a fitted lower garment intended to be an external garment, and so having an appearance that is sufficiently formal and modest to be worn out and in public (i.e. that does not appear to be a pajama bottom, girdle, or stocking). The legging in accordance with the present invention includes structural seaming at the center of the leg portions, at the lower waist, and in deep V-shape patterns down the lateral sides of the lower hips and upper thigh region of the garment. While these seams may be discrete, and in the same color as the fabric of the garment, they may also act to draw the eye in a way that gives the appearance of a more slender silhouette or they may also act with an internal structure to draw the eye away from the internal seams.

In addition, the legging includes mesh re-enforcement panels that line the interior of the legging in the sections between the seaming. In some embodiments, the bottom of these control panels may be floating, but preferably, the crotch is sewn together to form an under panty. Further, in some other embodiments, the control panel may be anchored along one or more vertical seams such as side seams (e.g., inside, outside), rise seams (e.g., front, back), and may be seamed at the crotch, either with the outer garment, or self-seamed. The outer garment is preferably made of a stretch fabric that also provides shape and give, but which conceals the control panels that provide a greater degree of giving support so as to balance the degree of control with the wearer's comfort. In at least one embodiment, the control panels may comprise spandex and/or elastomeric, and preferably mesh, and may be incorporated into the legging by sewing, gluing or adhering. Preferably, the controls panels are undercut and are configured to accentuate the anatomy so that the transition between areas which include the control and which do not form a smooth and un-intruded transition between the support and non-support sections of the garment. In particular, the bottom hem of the under panty is configured to either help to lift and tuck (for example the gluts) or to lie against a muscular transition (for example at the top of the hip crease).

The control panels may form part of an interior lining of the garment and may extend from the top edge seam of the outer garment to the lower control seams or even to the leg hems. The control panels may be anchored along one or more vertical seams such as side seams (e.g., inside, outside), center back seams, or any design seams (e.g., vertical stylish seams). One area of the interior re-enforcement sections may provide control to tone or more of the waist, abdomen, thigh and butt, which is advantageously achieved by a unique pattern and sizing of the control panels relative to the areas enveloped by them.

DETAILED DESCRIPTION OF THE INVENTION

Figure 1:
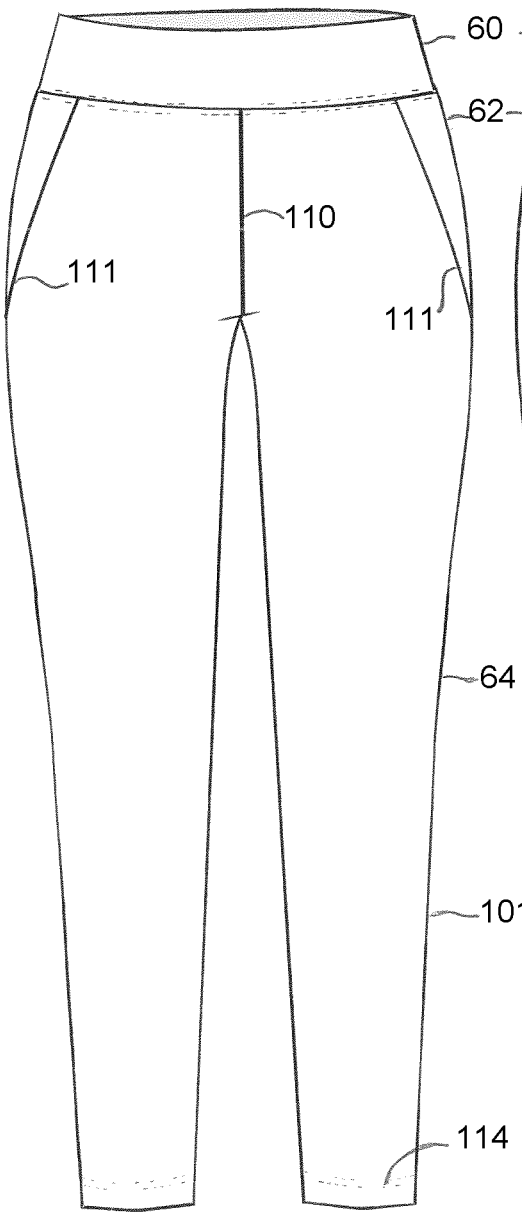
FIG. 1 shows the back of a legging in accordance with the present invention.
Figure 2:
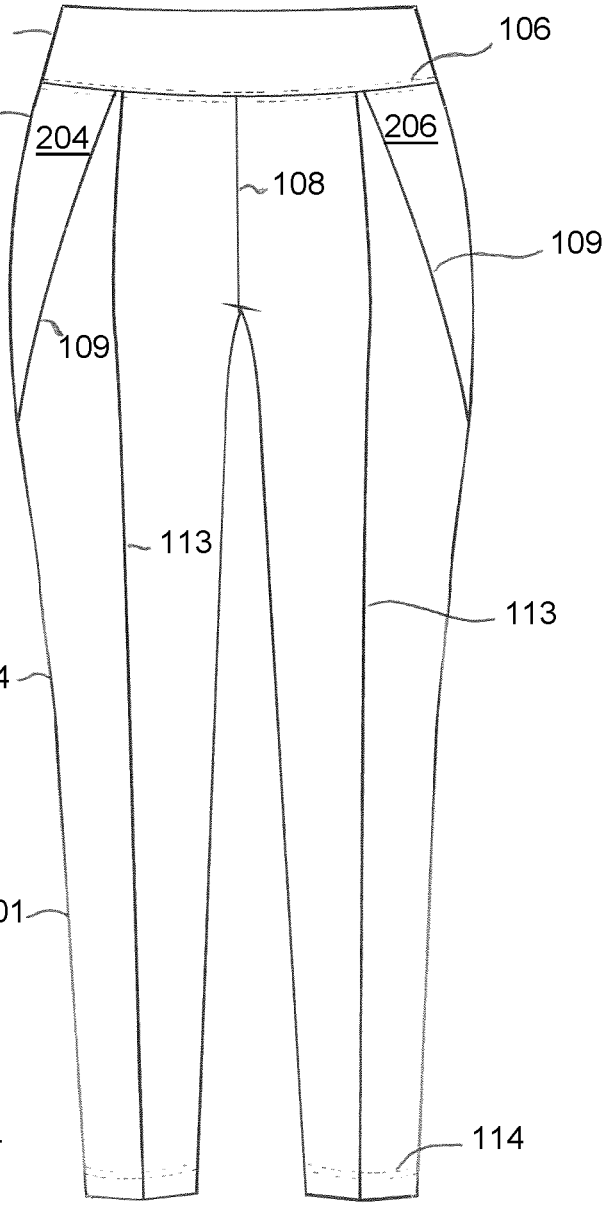
FIG. 2 shows the front of the legging of FIG. 1.
Figure 3:
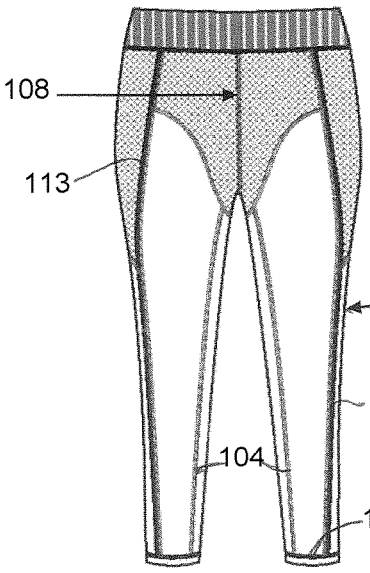
FIG. 3 shows the inside of the front of the legging of FIG. 1.
Figure 4:
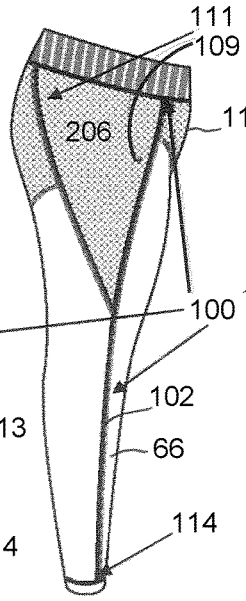
FIG. 4 shows the inside of the side of the legging of FIG. 1.
Figure 5:
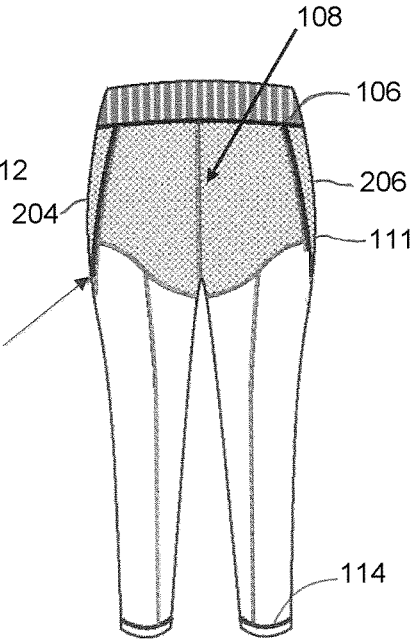
FIG. 5 shows the inside of the back of the legging of FIG. 1.

The present invention relates to lower outerwear, such as pants, or leggings, or skirts, including the skirts of dresses, that have various features that collectively contribute to an outwear garment that redefines the appearance and the shape of the wearer. FIGS. 1-7 illustrate a lower body garment 100, termed a "legging" herein which includes sections such as a waist 60, side hip areas 62, and leg portions 64 and seams including side seams 66, such as the outside seams 102 and inside seams 104, and center front rise seam 108 and center back rise seam 110 and additional seams that act to help define the appearance of the wearer in the garment, including front 109 and back 111 v-seams at the hips and front center seams 113 for the leg portions. The leg portions 64 or right leg covering 65 and left leg covering 67 refer to those portions of the garment that cover the leg, so for pants or leggings, the sleeve-like member intended for the leg, or the half sleeve which covers the thigh in a crotchless skirt. At the top, the lower body garment 100 may comprise a top edge seam 106. At the bottom, the lower body garment 100 may comprise an optional hem 114.

Inside, shown as the dashed line, the lower body garment 100 may comprise a support construct 112 comprising assembled internal support panels, for example comprised of a mesh having a substantial amount of support, and a little stretch. The exterior of the lower body garment 100 may be made from a stretch fabric such as Lycra or Spandex, or more particularly of a rayon/nylon ponte with from 2 to 12% spandex, and more preferably 5% +/−2% spandex, which provides for control, comfort, and coverage and which interfaces with the construct in a manner so that the construct 112 such that the control construct 112 is not visible from the outside. For example, the outer garment 101 may be made of lycra, spandex or similar stretch or elastomeric fabrics and the control construct 112 may be made of a non-stretch mesh or a stretch fabric such as a two or four way stretch fabric or mesh with for example, nylon and a higher percentage of spandex, such as 15-40%, or more particularly, 20% +/−5%, that has a limited amount of give.

Figure 6:
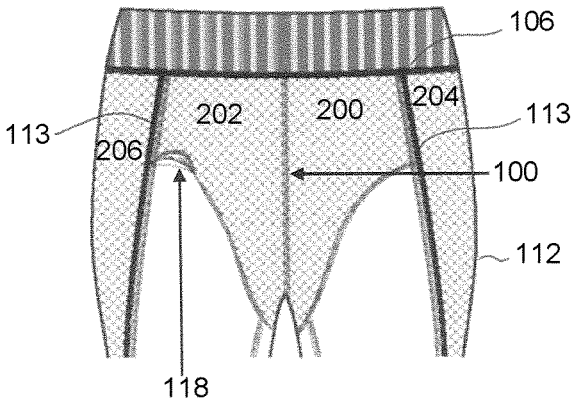
FIG. 6 shows a detail of the inside of the front of the legging of FIG. 1.
Figure 7:
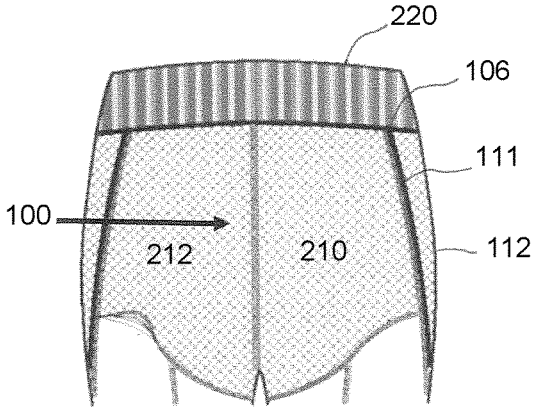
FIG. 7 shows a detail of the inside of the back of the legging of FIG. 1.

FIGS. 6-7 show the inside of the lower body garment 100 in which the construct 112 comprises an assemblage of pieces, (i.e. which are joined by sewing them together, or by sewing or adhering them to the exterior garment). The assemblage 112 may include a right 200 and left 202 front abdominal panel, side hip panels for the right (i.e., right lateral panel) 204 and left (i.e. left lateral panel) 206 sides and right 210 and left 212 buttock portions. Optionally, the leggings may include a waistband 220, such as an elastomeric ribbed waistband. The construct 112 may line the upper portion of the outer garment 101 inside both front and back, and may end at or slightly above the hip crease in a portion that is attached within the interior of the leggings or may float. Accordingly, the construct 112 may cover the full circumference of an interior waist of the outer garment 101. In some embodiments, the construct 112 may be anchored to the outer garment 101 for example, at the top edge seam 106 of the outer garment 101. The anchoring may be done by, for example, stitching or glue. In one non-limiting example, the anchoring may be done by ⅛ inch double needle stitch.

Moreover, in addition to anchoring at the top, the control construct 112 may be optionally anchored along one or more vertical seams such as side seams (e.g., outside seam 102), rise seams (e.g., front rise seam 108 and/or the back rise seam 110), as well as at its crotch or at the crotch of the outer garment. The dotted line 118 may be stitched to the front rise seam 108 (FIG. 6 shows the front inside) or back rise seam 110 (FIG. 7 shows the back inside). The side anchoring may be done by stitching (e.g., chain stitch) or glue. In some embodiments, the side anchoring may cover the full width of the construct 112, that is, from the top edge to the bottom edge of the construct 112. In some other embodiments, the side anchoring may cover only a partial length of the full width. For example, if the construct 112 is 5 inches from top to bottom, the side anchoring may be 5 inches of stitching, or the stitching may just cover the top 3 or 4 inches. It should be noted 5 inches is just an exemplary number, and the construct 112 may have a width that is reasonable to cover, at least partially, the lower abdominals of a wearer. For example, depending on the size and height of an intended wearer of the lower body garment 100, the construct 112 may have different widths.

In some embodiments, the bottom edge 116 of the construct 116 may be floating, that is, not anchored to the outer garment 101, and therefore not observable from the exterior of the garment. For example, the construct 112 may comprise two layers of lining fabric and the bottom of the two layers may be bound by stitching or glue, but may not be anchored to the outer garment 101. The bonding may be done by stitching (e.g., Merrow or purl stitches) or glue. In one embodiment, the two layers of fabric of the construct 112 may be tricot mesh and these two layers may be bound together at the bottom edge by 1/16-⅛ inch Merrow edge stitch.

The abdominal panels of the inner construct have a bottom boundary that is configured on each side in an s shape so that the lateral side is cut significantly higher than the inside. Preferably, the front panels 200, 202 end at the sides by attachment to the side panels 204, 206 so that the highest point of the bottom edge is medial to the wearer's outer hip crease and above the natural fold. Thus, the hem starts from a point that is forward of the side profile and roughly ⅕ to ⅓ of the way from the side edge (or the edge of the garment when empty and folded flat) to the center rise seam 108. This point of the bottom edge is also from ¼ to ½ of the distance from the top seam 106 to the crotch. The medial seam falls below the crotch by 0.25-3 inches, and preferably from 1-2 inches. The side panels 204, 206 taper down the leg, so that the top distance circumferentially is approximately ⅓ (i.e. from ⅕-½) of the length of one half of the garment taken along the seam 106 (see for example FIG. 4). The back panels 210, 212 extend slightly farther across the back body of the pant, and the back lateral portion for the side panel takes up from 1/10 to ⅓ of the length of half of the distance across the back half of the pant (i.e. side edge when folded to the back center seam 110). The back edge of the inner construct is similarly s-shaped on each side so that the lateral side joins the tapering side panel at a distance that is ½ to all of the way vertically to the crotch. The edge is cut up on the lateral side approximately ¼-⅓ of the way across the back so that the panty is undercut relative to the buttock of the wearer. The medial edge falls below the crotch by an amount similar to the front panels.

What is claimed is:

1. An outer wear item comprising:

an outer garment made from a stretch fabric with 2-12% Spandex and having a right leg covering and a left leg covering, the right and left leg coverings being integral at a superior region with a lower body member, the lower body member including a front body panel having a front rise seam, and a back portion having a back rise seam, and a waistband; and an inner control construct comprising an under panty made from a stretch fabric with 15-40% Spandex and joined to the outer garment at the waistband, the inner control construct comprising a front abdominal panel having a front abdominal panel hem, and a back body portion which is stitched to the back portion of the outer garment in the back rise seam and has a back body portion hem, and the front abdominal panel is joined at a crotch member to the back body portion, and the front abdominal panel and the back body portions each have a left lateral side and a right lateral side, and the left lateral side of the front abdominal panel is joined to the right lateral side of the back body portion and the right lateral side of the front abdominal panel is joined directly or indirectly to the left lateral side of the back body portion, and the front abdominal panel hem terminates on the right lateral side and on the left lateral side superiorly to the crotch member, and the back body portion hem is cut and configured to lay at and lift a wearer's gluteal flesh and the front abdominal panel hem is configured to lie against a wearer's hip crease.

2. An outer wear item as set forth in claim 1, wherein the outer garment is a pant, trouser or legging.

3. An outer wear item as set forth in claim 1, wherein the outer garment includes a right lateral panel that forms a tapered shape that extends downward from the waistband to have an apex on the right leg covering and a left lateral panel that forms a tapered shape that extends downward from the waistband to have an apex on the left leg covering.

4. An outer wear item as set forth in claim 3, wherein the right and the left lateral panels of the outer garment each includes front seams and the inner control construct is seamed with the outer garment in the front seams of the right lateral panel and the left lateral panel.

5. An outer wear as set forth in claim 1, wherein the inner control construct has a lower boundary that floats relative to the outer garment.

6. An outer wear item comprising:

an outer garment which is a pant, legging, or trouser, constructed from a stretch fabric, and having a right leg portion and a left leg portion which are integral at a superior region with a lower body member, the lower body member including a front body panel having a front rise seam, a back portion having a back rise seam, and a left side hip panel which forms a shape that tapers downward to an apex and a right side hip panel that forms a shape that tapers downward to an apex, and the right side hip panel and the left side hip panel are joined directly or indirectly together at a waistband to form the outer garment, the outer garment being joined to an inner control construct constructed from a stretch mesh fabric, the inner control construct comprising a front abdominal panel which is stitched to the front body panel of the outer garment in the front rise seam, a crotch member and a back gluteal portion which is stitched to the back portion of the outer garment in the back rise seam, and the front abdominal panel is joined at the crotch member to the back gluteal portion, and the front abdominal panel and the back gluteal portions each have a left lateral side and a right lateral side, and the left lateral side of the front abdominal panel is joined to the right lateral side of the back gluteal portion and the right lateral side of the front abdominal panel is joined to the left lateral side of the back gluteal portion, and the front abdominal panel terminates on the right lateral side and on the left lateral side superiorly to the crotch member.

7. An outer wear item as set forth in claim 6, wherein the inner control construct has a lower boundary that floats relative to the outer garment.

8. An outer wear item as set forth in claim 6, wherein the outer garment includes outer garment side seams on the lateral sides, and the inner control garment side seams are at least partially seamed with the out garment side seams.

9. An outer wear item comprising:

a pant or legging, constructed from a stretch fabric, and having a right leg portion and a left leg portion, the right leg portion and the left leg portion being integral at a superior region with a lower body member, the lower body member including a front body panel having a front rise seam, a left side portion which has a left side hip panel having tapered structural seams, a right side portion which has a right side hip panel having tapered structural seams and a back portion having a back rise seam, the front body panel, the left side portion, the right side portion and the back portion being joined together at a waistband to form the pant or legging, where the right side portion is a mirror image of the left side portion and which taper away from the waistband, the pant or legging being joined to an inner control construct constructed from a stretch mesh fabric and which comprises a front abdominal panel which is anchored to the front body panel of the pant or legging in the front rise seam, a crotch member and a back gluteal portion which is anchored to the back portion of the pant or legging in the back rise seam, and the front abdominal panel is joined at the crotch member to the back gluteal portion, and the front abdominal panel and the back gluteal portions each have a left lateral side and a right lateral side, and the left lateral side of the front body panel is joined to the right lateral side of the back gluteal portion and the right lateral side of the front abdominal panel is joined to the left lateral side of the back gluteal portion.

10. An outer wear item as set forth in claim 9, wherein the front abdominal panel terminates on the right lateral side and on the left lateral side superiorly to the crotch member.

* * * * *